United States Patent [19]

Van Patten

[11] 4,401,187

[45] Aug. 30, 1983

[54] LADDER PLATFORM ACCESSORY

[76] Inventor: Charles E. Van Patten, 2300 Crocker Ave., Portsmouth, Va. 23703

[21] Appl. No.: 296,289

[22] Filed: Aug. 26, 1981

[51] Int. Cl.[3] ..... E06C 7/16

[52] U.S. Cl. ..... 182/121; 248/238

[58] Field of Search ..... 182/121, 122, 120, 214; 248/238, 210, 247, 248

[56] References Cited

U.S. PATENT DOCUMENTS

| | | | |
|---|---|---|---|
| 407,079 | 7/1889 | Laskey | 182/121 |
| 787,911 | 4/1905 | Gerhardt | 248/210 |
| 1,226,853 | 5/1917 | Bourdeau . | |
| 1,760,803 | 5/1930 | Wirth . | |
| 1,906,275 | 5/1933 | Kramer | 248/210 |
| 1,920,552 | 8/1933 | Dollerhide . | |
| 1,972,211 | 9/1934 | Weisgraber | 248/238 |
| 2,000,483 | 5/1935 | Hogelin . | |
| 2,067,188 | 1/1937 | Hennessy | 248/238 |
| 2,104,987 | 1/1938 | Harding . | |
| 2,419,727 | 4/1947 | Picone . | |
| 2,439,185 | 4/1948 | Patt | 182/121 |
| 2,488,984 | 11/1949 | Pennington | 248/238 |
| 2,500,559 | 3/1950 | Miller . | |
| 2,508,258 | 5/1950 | Heinrich | 248/210 |
| 2,557,270 | 6/1951 | Franklin | 248/238 |
| 2,578,862 | 12/1951 | Tims | 182/121 |
| 2,726,901 | 12/1955 | Newman | 182/120 |
| 2,801,886 | 8/1957 | Peterson . | |
| 3,067,836 | 12/1962 | Carnicelli | 182/121 |
| 3,223,368 | 12/1965 | Benninger | 248/210 |
| 3,495,683 | 2/1970 | Broden | 248/210 |
| 3,503,468 | 3/1970 | Taylor | 182/121 |
| 3,511,338 | 5/1970 | Chapman | 182/121 |
| 3,559,939 | 2/1971 | Luna | 248/210 |
| 3,568,801 | 3/1971 | Werner | 182/214 |
| 3,792,750 | 2/1974 | Madison | 248/238 |
| 3,899,045 | 8/1975 | Geisel | 182/121 |
| 4,099,693 | 7/1978 | Blann | 248/210 |
| 4,186,903 | 2/1980 | Fazakerley | 248/210 |

FOREIGN PATENT DOCUMENTS

| | | | |
|---|---|---|---|
| 658434 | 12/1963 | Italy | 182/120 |
| 127486 | 9/1928 | Switzerland | 182/120 |
| 2036152 | 6/1980 | United Kingdom | 182/121 |

*Primary Examiner*—Reinaldo P. Machado
*Assistant Examiner*—Alvin Chin-Shue
*Attorney, Agent, or Firm*—Griffin, Branigan & Butler

[57] ABSTRACT

A platform accessory (20) for use with a straight ladder (22) includes a flat deck (40) adapted both to engage a lower rung (26L) of the ladder (22) and to connect to a higher portion of the ladder by a pair of resilient bracket arms (82). Lower portions (86) of the bracket arms are hingedly connected to the deck (40); intermediate portions (88) of the bracket arms (82) wrap around the ladder's side rails (24); and, upper portions (90) of the bracket arms are insertable into apertures formed in the side rails (24). In one embodiment, apertures (32) in the side rails (24) communicate with interior portions of hollow rungs.

11 Claims, 11 Drawing Figures

LADDER PLATFORM ACCESSORY

BACKGROUND OF THE INVENTION

This invention relates to platform accessories, and particularly to platform accessories for use with straight ladders.

For countless decades the straight ladder has enabled man to elevate himself and perform tasks which otherwise would be beyond his reach. Few individuals have not had occasion to mount a ladder to perform such tasks as painting or repairing an overhead or tall structure, for example. Even the novice ladder climber realizes that some peril attends ascension of a ladder and that a delicate balance must be maintained to avoid danger.

Professionals who remain perched aloft for untold hours are also conscious of the tiring stress of a prolonged stance in an arch-over-rung position. A sustained stance on a ladder rung often causes fatigue of tendons and leg muscles, and may even result in soreness and abrasions to the shin should one lean forward against a higher rung.

The advent of the flat-top rung offered some relief to the sore-arched professional, but did not eliminate the above problems altogether. Various ladder-attached platforms have also appeared through the years, usually comprising a flat platform mounted above a lower rung and suspended from a higher rung. Examples of such devices are seen in U.S. Pat. Nos. 407,079 to Laskey; 1,760,803 to Wirth; 1,920,552 to Dollerhide; 2,067,188 to Hennessy; 2,104,987 to Harding; 2,419,727 to Picone; 2,488,984 to Pennington; 2,500,559 to Miller; and 2,578,862 to Tims.

Few at best of the ladder-attached platforms disclosed in the prior art appear to have sufficiently remedied the problems attendant ladder usage to merit commercial acceptability. Most devices of this type suffer from an unnerving instability. One factor contributing to the instability of such devices is the excessive tolerances with which prior-art hook-like structures engage rungs from which the platform is suspended. Although some devices seek to lessen such tolerances by additionally incorporating various fastening or securing means, repeated loosening and tightening of the additional means when changing the position of the platform requires extra effort and time.

Prior art ladder-attached platforms are also unstable inasmuch as the body weight of the user is often not properly positioned with respect to the platform. In this respect, many devices are dimensioned and mounted so that the center of gravity of the ladder user causes the platform to rock, wobble, or even slip.

Therefore, an object of this invention is the provision of a ladder platform accessory which permits a user to stand firmly erect, thereby eliminating abnormal pressure and strain to the arches, balls of the feet, leg and back muscles, and the shin.

An advantage of this invention is the provision of a ladder platform accessory wherein a user's center of gravity is positioned above a rung of a ladder.

Another advantage of this invention is the provision of a ladder platform accessory having ample, unobstructed footing in both width and depth.

Another advantage of this invention is the provision of a ladder platform accessory that will not rock nor slip.

Another advantage of this invention is the provision of a ladder platform accessory which may easily be changed from one ladder rung to another.

Yet another advantage of this invention is the provision of a ladder platform accessory wherein a platform portion may be selectively adjustable to remain essentially horizontally oriented although the ladder may be utilized through a range of inclinations to the vertical.

SUMMARY

A platform accessory for use with a straight ladder includes a flat deck adapted both to engage a lower rung of the ladder and to connect to a higher portion of the ladder by a pair of resilient bracket arms. Lower portions of the bracket arms are hingedly connected to the flat deck; intermediate portions of the bracket arms wrap around the ladder's side rails; and, upper portions of the bracket arms are insertable into apertures formed in the side rails. In one embodiment, the apertures in the side rails communicate with interior portions of hollow rungs.

BRIEF DESCRIPTION OF THE DRAWINGS

The foregoing and other objects, features, and advantages will be apparent from the following more particular description of a preferred embodiment of the invention, as illustrated in the accompanying drawings in which like reference characters refer to the same parts throughout the different views. The drawings are not necessarily to scale, emphasis instead being placed on illustrating principles of the invention in a clear manner.

DETAILED DESCRIPTION OF THE DRAWINGS

Figure 1:
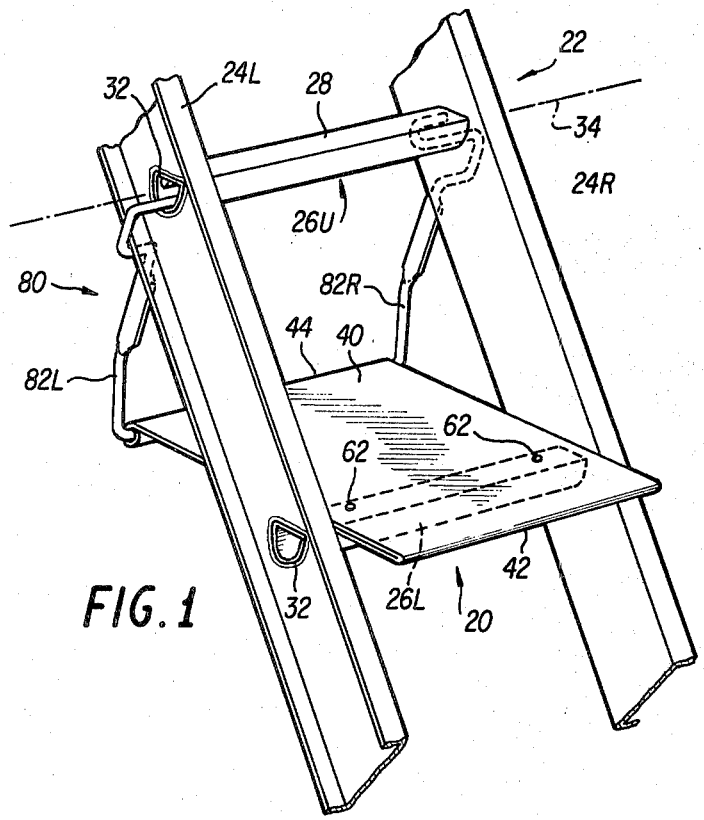
FIG. 1 is a perspective view of a ladder platform accessory according to one embodiment of the invention.

FIG. 1 illustrates a ladder platform accessory 20 mounted on a conventional hollow-rung metal ladder 22. The ladder 22 comprises two side rails 24L and 24R connected by a plurality of rungs 26. In this respect, FIG. 1 shows an upper rung 26U and a lower rung 26L of the ladder 22. A flat top portion 28 together with an essentially "V"-shaped underside portion of the rung 26 define an essentially hollow rung interior 30. The hollow rung interior communicates with apertures 32 formed at the intersection of the hollow rung 26 and each side rail 24.

For purposes of the ensuing discussion, a rung axis 34 extends centrally through the elongate dimension of rung 26 (and hence is essentially perpendicular to the elongate dimension of the side rail 24). Also, the elongate dimension of each side rail 24 is considered to lie in a plane which is perpendicular to the rung axis 34. In this respect, the plane of each side rail 24 extends out of the plane of the drawing of FIG. 3A such that the edge of the plane containing side rail 24 is essentially seen as the underside edge 36 of the side rail 24.

The ladder platform accessory 20 comprises a flat platform member or deck 40 having a front edge 42 and a back edge 44, edges 42 and 44 being essentially parallel to the rung axis 34. The flat platform 40 is preferably fabricated from a sheet of aluminum approximately $\frac{1}{8}$ inch thick.

Figure 5A:
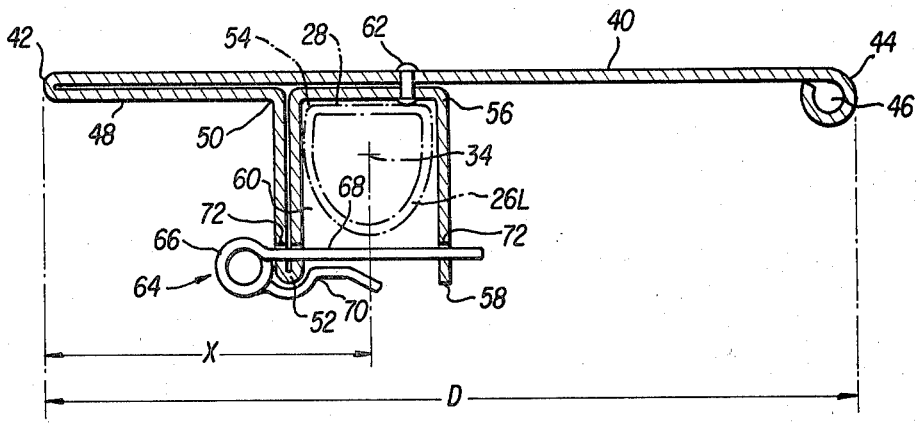
FIG. 5A is a partial side view of a ladder platform accessory fabricated for use with a flat-top rung ladder.

As seen in FIG. 5A, the back edge 44 of the flat platform 40 is curled back onto its underside to form an essentially cylindrical hollow channel 46 which runs across the width of the platform 40. The front edge 42 of the platform 40 is folded back on itself at 360° to form a platform underside portion 48 which, after a series of bends as hereinafter described, engages the ladder rung 26L. After being bent at front edge 42, the sheet from which the platform 40 is fabricated continues rearwardly until it is bent downwardly at 90° (as indicated at bend 50), after which it continues downwardly until it is bent 360° at bend 52. From bend 52 the sheet continues upwardly until it is bent 90° rearwardly at bend 54. The sheet including underside portion 48 then continues rearwardly until it is bent 90° downwardly at bend 56. The sheet terminates at a point 58 which lies at the same distance from the upper surface of the deck 40 as does band 52. Thus, a rung channel 60 is formed on the underside portion 48 of the deck 40 from bend 52 to termination point 58. A portion of the rung channel 60 from bend 54 to bend 56 is adapted to fit over the flat top 28 of the rung 26L. In this respect, the distance from bend 54 to 56 is appropriately dimensioned to accommodate the flat top 28 of the ladder rung 26L. A plurality of fasteners (such as cadmium-plated rivets 62) arranged across the width of the platform 40 secure the rung-engaging portion of the underside 48 of the platform sheet to the deck 40.

With respect to the flat platform member 40 of FIG. 5A, a distance X separates the front edge 42 of the platform 40 from the center 34 of the rung 26L. The distance from the front edge 42 to the back edge 44 is given as a depth D. The ladder platform accessory 20 is fabricated such that the ratio X:D lies in a range of between 0.3 and 0.5, and preferably is approximately 0.4. As seen hereinafter with respect to FIG. 7, these dimensional relationships of X and D position the user's center of gravity directly over the rung 26L.

FIG. 5A further illustrates a locking means, such as spring securing pin 64 used to lock the deck 40 in place about the rung 26L, particularly when the ladder 22 is being moved. Securing pin 64 comprises an easily-grasped ring member 66 having two legs 68 and 70 extending rearwardly therefrom. The upper leg 68 extends through suitably drilled apertures 72 in the rung channel 60. The lower pin leg 70 is curved to resiliently bear against the underside of bend 52.

Figure 3B:
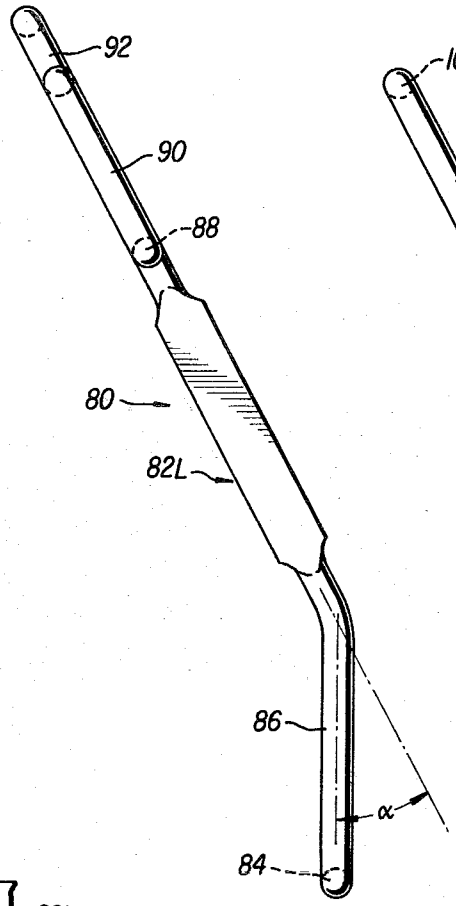
FIG. 3B is a side view of a bracket arm utilized with the embodiment of FIG. 1.
Figure 3A:
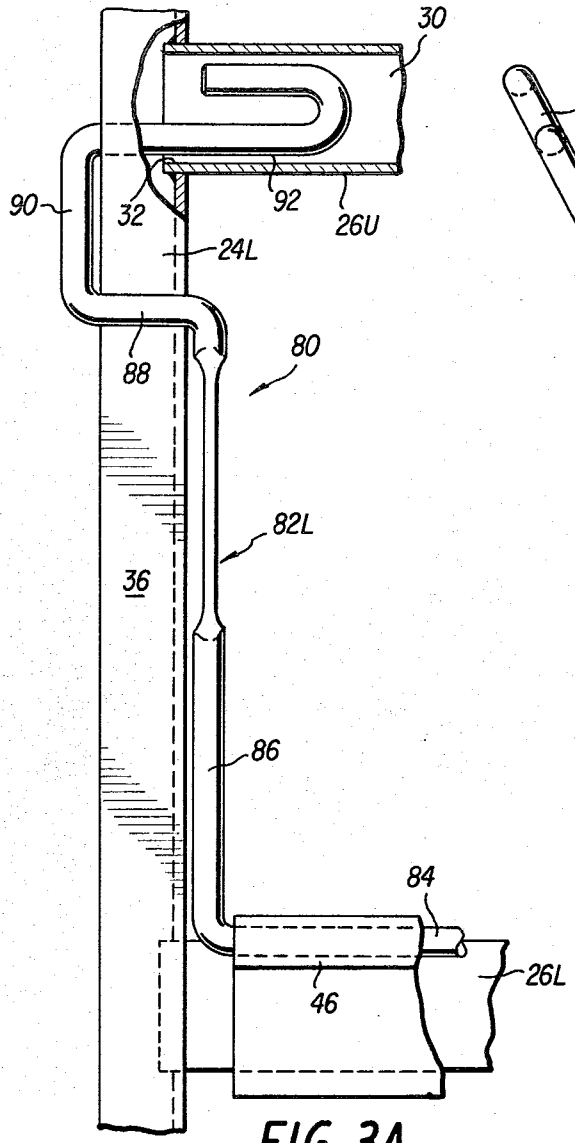
FIG. 3A is a partial rear view of the embodiment of FIG. 1.

As seen in FIG. 1 taken in conjunction with FIG. 3A, the ladder platform accessory 20 further comprises bracket means 80 which includes left and right bracket arms 82L and 82R, respectively. Bracket means 80 is fabricated from resilient tempered spring steel of approximately $\frac{3}{8}$ inch diameter. Bracket arms 82L and 82R, which extend essentially vertically when the accessory 20 is in the position of use of FIG. 1, are connected by an essentially horizontally-oriented bracket portion 84. The horizontal bracket portion 84 extends through the channel 46 formed at the back edge 44 of the deck 40 to form a friction-fit hinge.

Each bracket arm 82 comprises a lower bracket arm end portion 86; an intermediate bracket arm portion 88; and, an upper bracket arm end portion 90. The lower bracket arm end 86 portion is connected with the horizontal bracket portion 84 to engage the rear edge 44 of the deck 40. The lower bracket arm end portion 86 extends upwardly (essentially vertically) and is bent at approximately 30° (angleαin FIG. 3B) before continuing upwardly. The bracket arm end portion 86 remains inside of the side rail-containing plane seen as side rail edge 36 in FIG. 3A. That is, lower bracket arm portion 86 travels vertically upwardly on the right side of the left side rail 24L as seen in FIG. 3A.

The intermediate bracket arm portion 88 extends from just inside the side rail-containing plane to just outside the plane (that is, from right to left across the side rail 24L as seen in FIG. 3A) and bears against the underside edge 36 of the side rail 24L. The upper bracket arm end portion 90 travels along the outside of the side rail 24L and has an essentially U-shaped portion 92 of resilient tempered spring steel which is insertable through the aperture 32 in the side rail 24 and into the hollow rung interior 30 for a snug fit. In this respect, a one-sixteenth inch tolerance is appropriate for the fit of portion 92 into aperture 32.

Figure 2:
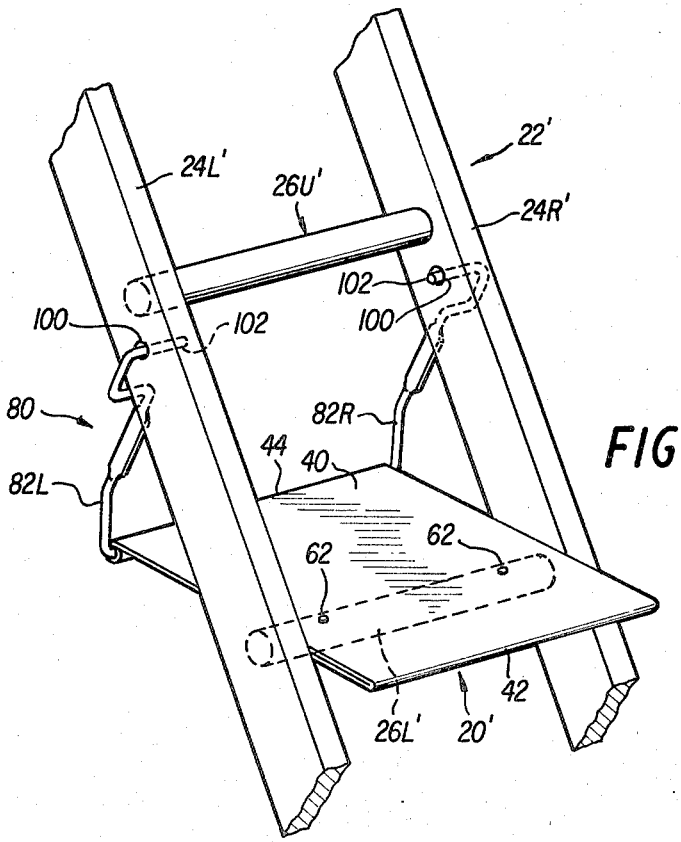
FIG. 2 is a perspective view of a ladder platform accessory according to another embodiment of the invention.

FIG. 2 illustrates a ladder platform accessory 20′ similar to the accessory 20 of FIG. 1 but adapted to be used in conjunction with a ladder 22′ which does not have hollow rungs. In this respect, the ladder 22′ of FIG. 2 has solid rungs 26′ which, for purposes of illustrating a yet further embodiment of the invention, are shown to be round. Unless mentioned otherwise hereinafter, unprimed reference numerals in FIG. 2 should be understood to refer to corresponding elements in the FIG. 1 embodiment.

Figure 4B:
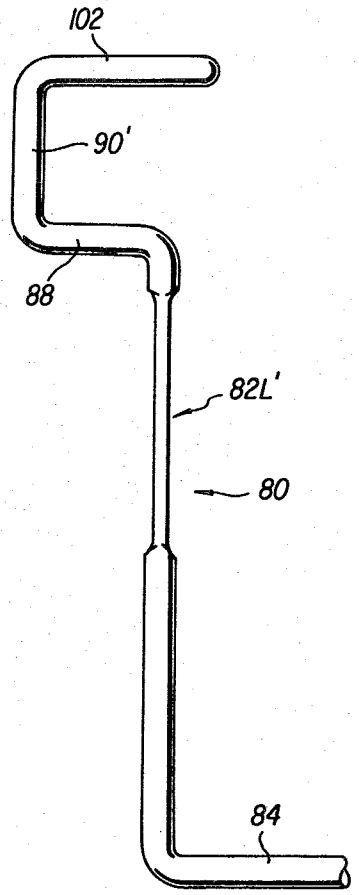
FIG. 4B is a side view of FIG. 4A.
Figure 4A:
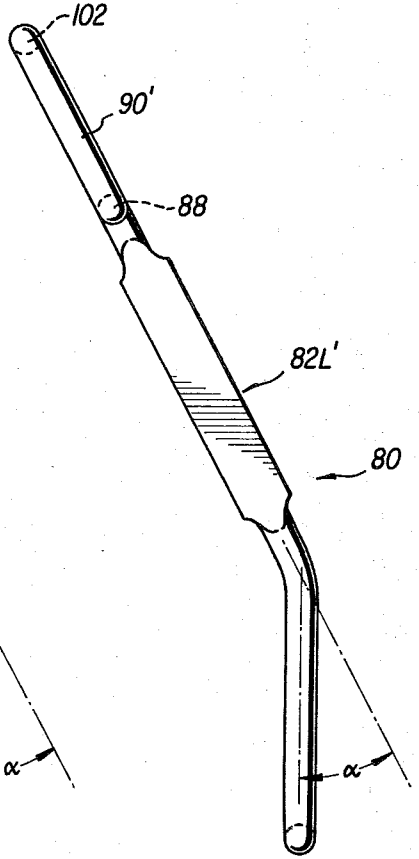
FIG. 4A is a rear view of a bracket arm utilized with the embodiment of FIG. 2.

The ladder 22′ is adapted to accommodate the ladder accessory 20′ by having apertures 100 drilled through the width of the side rails 24′. As seen with reference to FIGS. 4A and 4B, the upper bracket arm end portion 90′ basically differs from the corresponding portion 90 of the FIG. 1 embodiment in that the upper bracket arm end portion 90′ comprises an essentially straight, horizontally-oriented portion 102 which is insertable through the aperture 100, rather than a U-shaped portion. Again, a one-sixteenth inch tolerance is appropriate for the fit of portion 102 into aperture 100.

Figure 5B:
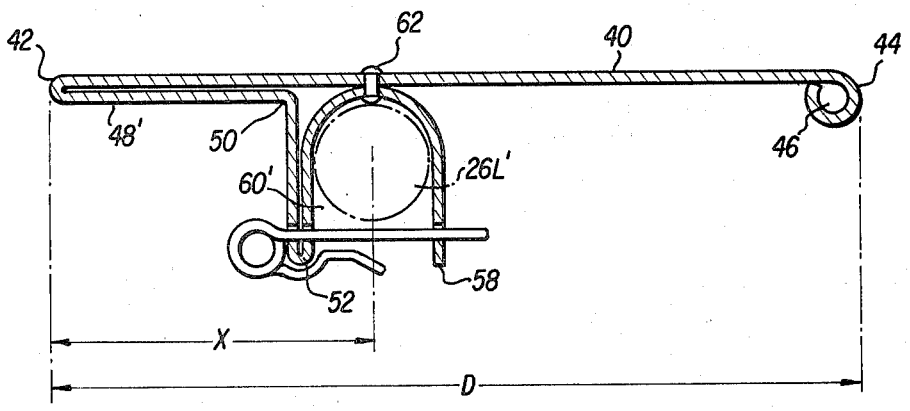
FIG. 5B is a partial side view of a ladder platform accessory fabricated for use with a round-rung ladder.

FIG. 5B illustrates an embodiment of the invention wherein an underside portion 48′ of the deck 40 is fabricated to accommodate a round rung 26L′. In this respect, the underside portion 48′ of deck 40 resembles the underside portion 48 of the deck of FIG. 5A in having bends 50 and 52, but differs in that after continuing upwardly from bend 52 the sheet is curved in a half-circular fashion. The dimensional ratios for the distances X and D for the FIG. 5B embodiment are the same as those given for FIGS. 5A above.

Figure 6A:
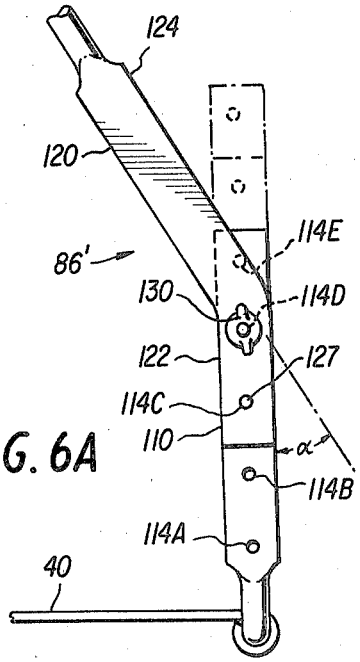
FIG. 6A is a partial side view of an adjustable bracket arm.
Figure 6B:
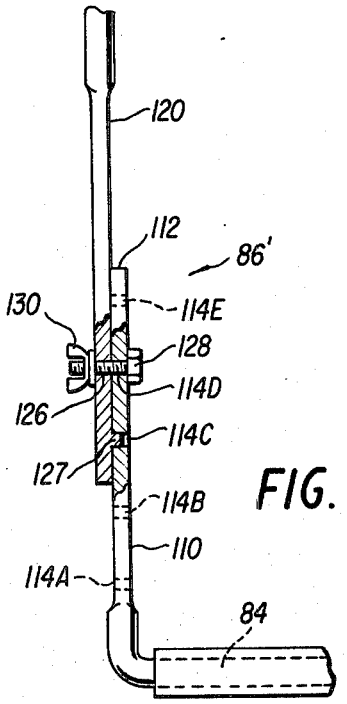
FIG. 6B is a rear view of FIG. 6A.

FIGS. 6A and 6B illustrate a further embodiment of the invention wherein the length of a lower bracket arm end portion 86′ is adapted to be selectively adjustable and thereby facilitate the essentially horizontal orientation of the deck 40 throughout a range of inclinations of the ladder 22 to the vertical. In this respect, the lower bracket arm end portion 86′ of FIGS. 6A and 6B comprise an essentially straight member 110 which is integral with the horizontal bracket portion 84 much in the manner described above. The straight member 110 of lower bracket arm end portion 86′ extends vertically upward and terminates at a point 112. The straight member 110 has a plurality of apertures 114 extending therethrough in spaced-apart relationship.

The lower bracket arm end portion 86′ of FIG. 6A and 6B further comprises a bent member 120 which has a lower leg 122 and an upper leg 124. Lower leg 122 has at least one aperture 126 therethrough and a stud 127. When the aperture 126 of lower leg 122 is aligned with a desired aperture 114 of the straight portion 110, a locking means, such as a threaded bolt 128, may be inserted therethrough and secured with a wing nut 130. The stud 127 is appropriately spaced from the aperture 126 so that the stud 127 protrudes into one of the apertures 114 on member 110 other than the aperture 114 through which the bolt 128 is inserted. When assembled in this fashion, it is seen that the upper leg 124 of the bent member 120 is bent at an angle$\alpha$with respect to the lower leg 122, and that the angle$\alpha$is approximately 30°.

From the above discussion, it should be understood that the choice of which aperture 114 through which the bolt 128 should extend is dependent upon the angle of inclination to the vertical of ladder 22 such that the deck 40 may remain essentially horizontal regardless of the degree of ladder inclination.

In operation, the deck 40 of the accessory 20 is positioned over a rung 26L by placing the rung channel 60 over the rung 26L. If a securing pin 64 is utilized, it is inserted through apertures 72 in the rung channel 60. With the deck 40 assuming an essentially horizontal position, the resilient bracket arms 82L and 82R are manually spread apart so that the inwardly-most extending portion of the upper bracket arm end portion 90 sufficiently clears the respective side rails 24L and 24R. The spread bracket arms 82L and 82R are then positioned so that members 92 of the embodiment of FIGS. 1 and 3 (or members 102 of the embodiment of the FIGS. 2 and 4) are aligned with apertures 32 (or 100). When the spreading pressure on the bracket arms 82L and 82R is released, the members 92 (or 100) snugly fit into the apertures 32 (or 100). With respect to the FIG. 1 embodiment, the insertion of the resilient U-shaped member 92 into the hollow rung interior 30 slightly deflects member 92, resulting in a pressure bearing against the interior walls of the rung 26U.

Figure 7:
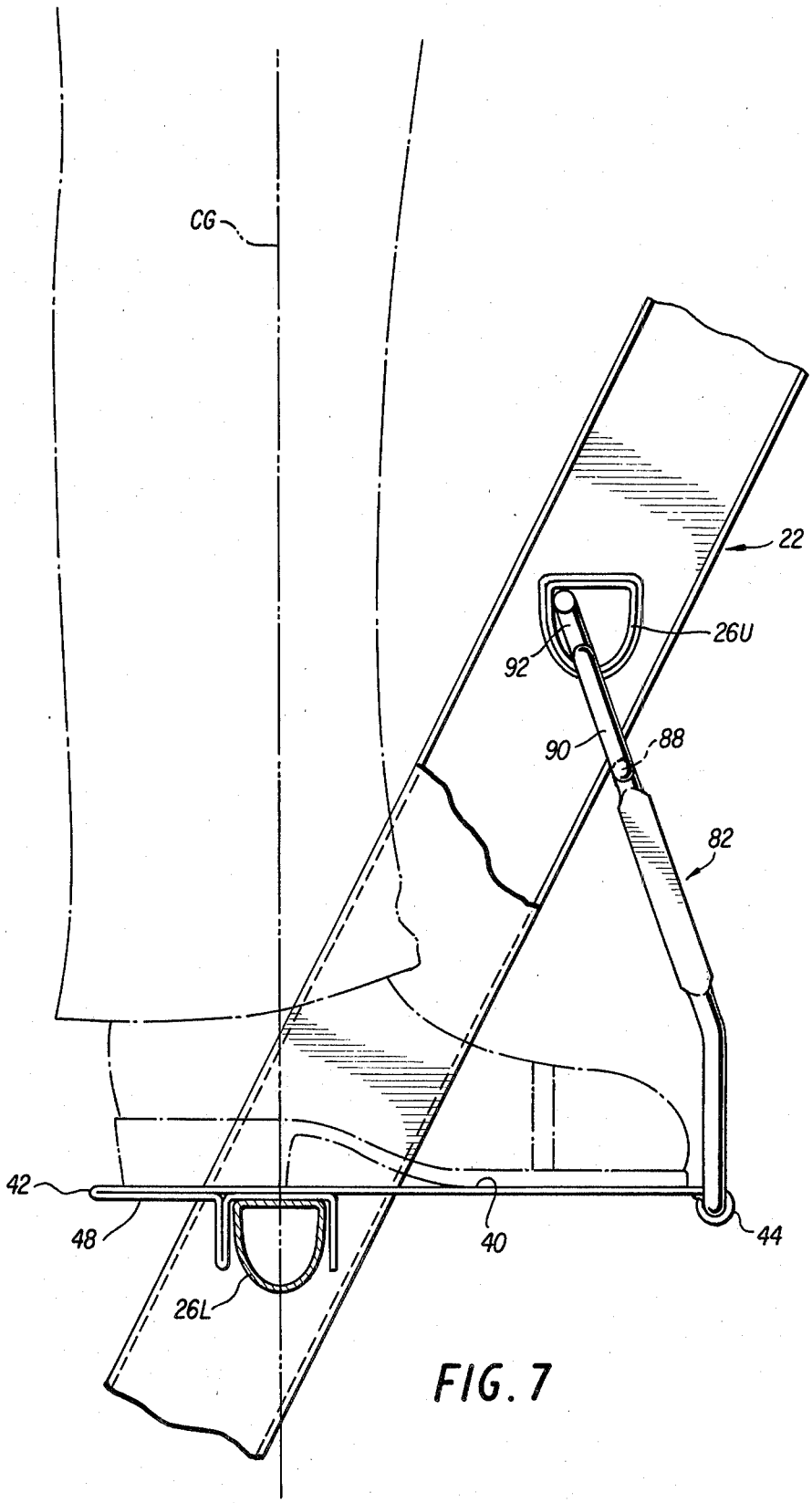
FIG. 7 is a side view of the embodiment of FIG. 1 showing a user positioned thereon.

FIG. 7 illustrates an embodiment of the ladder platform accessory 20 of FIG. 1 showing a user positioned thereon. When the platform accessory 20 is constructed in accordance with the dimensional ratios given in connection with the discussion of FIG. 5, the user's vertical center of gravity (CG) is positioned over the center of the rung 26L. The deck 40 has a double thickness near the front edge 42 and under the heel and arch of the user for added support. The deck 40 advantageously stretches across the ladder 22 substantially from side rail 24L to 24R, thereby providing ample, unobstructed foot space in both width and depth.

It should be evident that the platform ladder accessory of the invention can be conveniently repositioned from one rung to another. Further, a plurality of accessories according to the invention can be utilized on the same ladder, even on adjacent rungs, without impeding the attachment to the ladder of any of the accessories.

While the invention has been particularly shown and described with reference to the preferred embodiments thereof, it will be understood by those skilled in the art that various alterations in form and detail may be made therein without departing from the spirit and scope of the invention. For example, rather than using the rivets 62, a weld may be employed between the deck 40 and its underside portion 48.

The embodiments of the invention in which an exclusive property or privilege is claimed are defined as follows:

1. A platform accessory selectively attachable to a ladder, said ladder having two side rails connected by a plurality of hollow rungs, said accessory comprising:

an essentially flat platform member adapted to engage a first rung of said ladder, said platform member having first and second edges oriented essentially parallel to the axis of said first rung;

bracket means by which said platform member is connected to a second rung of said ladder, said second rung being vertically above said first rung, said bracket means comprising bracket arms associated with each of two said side rails, said bracket arms being oriented essentially vertically when said ladder is in a position of use, each of said bracket arms having a lower bracket end portion, an upper bracket end portion, and an intermediate bracket portion between said upper and lower end portions, said lower bracket end portion of each bracket arm being engageable with said second edge of said platform member and extending upwardly therefrom just inside a vertical plane wherein said associated side rail lies;

said upper bracket end portion of each bracket arm being securely insertable into the hollow portion of said second rung of said ladder, said upper end portion extending into said second rung from outside said vertical plane wherein said associated side rail lies; and, said intermediate bracket portion extending from just inside said vertical plane portion wherein said associated side rail lies to just outside said vertical plane and bearing against said associated side rail.

2. A platform accessory selectively attachable to a ladder, said ladder having two side rails connected by a plurality of rungs, said side rails having apertures extending therethrough, said accessory comprising:

an essentially flat platform member adapted to engage a first rung of said ladder, said platform member having first and second edges oriented essentially parallel to the axis of said first rung;

bracket means connected to said platform member and engaging said ladder, said bracket means comprising bracket arms associated with each of two said side rails, said bracket arms being oriented essentially vertically when said ladder is in a position of use, each of said bracket arms having a lower bracket portion, an upper bracket end portion, and an intermediate bracket portion between said upper and lower end portions, said lower bracket end portion of each bracket arm being engageable with said second edge of said platform member and extending upwardly therefrom just inside a vertical plane wherein said associated side rail lies;

said upper bracket end portion of each bracket arm being securely insertable into an aperture extending through a side rail associated with said bracket, said upper end portion extending into said aperture from outside said vertical plane wherein said associated side rail lies; and, said intermediate bracket portion extending from just inside said vertical plane portion wherein said associated side rail lies to just outside said vertical plane and bearing against said associated side rail.

3. The platform accessory of claim 1, wherein said bracket means further comprises an essentially horizontally oriented bracket portion intermediate said bracket arms and engaged by said second edge of said platform member.

4. The platform accessory of claim 1, wherein said upper bracket portions of said bracket arms comprise an essentially U-shaped portion insertable into said hollow portion of said second rung.

5. The platform accessory of claim 1 or 2, wherein said bracket means comprise resilient tempered spring steel.

6. The platform accessory of claim 1 or 2, wherein said platform member is essentially folded back under itself at said first edge thereof to form a platform underside portion adapted to engage said first rung of said ladder.

7. The platform accessory of claim 6, wherein at least a portion of said underside portion of said platform member is fabricated to partially conform to the exterior of said first rung.

8. The platform accessory of claim 7, wherein at least a portion of said underside portion of said platform member is semi-circular.

9. The platform accessory of claim 1, wherein said axis of said rung lies at distance X from said first platform edge, and wherein the ratio of distance X to the total distance between said first edge and said second edge is in the range of 0.3 to 0.5.

10. The platform accessory of claim 7, wherein said ratio is approximately 0.4.

11. The platform accessory of claim 1, wherein the length of said lower end portion of said bracket arm is selectively adjustable.

* * * * *